US012006952B2

(12) United States Patent
Juan

(10) Patent No.: US 12,006,952 B2
(45) Date of Patent: Jun. 11, 2024

(54) SUSPENSION ASSEMBLY OF INDUSTRIAL FAN

(71) Applicant: BEST FAN INC., Taichung (TW)

(72) Inventor: Chen-Hsiung Juan, Taichung (TW)

(73) Assignee: Best Fan Inc., Taichung (TW)

( * ) Notice: Subject to any disclaimer, the term of this patent is extended or adjusted under 35 U.S.C. 154(b) by 36 days.

(21) Appl. No.: 17/886,910

(22) Filed: Aug. 12, 2022

(65) Prior Publication Data

US 2023/0056751 A1 Feb. 23, 2023

(30) Foreign Application Priority Data

Aug. 20, 2021 (TW) ..... 110130916

(51) Int. Cl.
*F04D 29/64* (2006.01)
*F04D 25/08* (2006.01)
*F04D 29/60* (2006.01)

(52) U.S. Cl.
CPC ..... *F04D 29/646* (2013.01); *F04D 25/088* (2013.01); *F04D 29/601* (2013.01)

(58) Field of Classification Search
CPC ..... F16M 11/10; F16M 11/2064; F16M 11/2014; F16M 13/02; F04D 25/088; F04D 29/646; F04D 29/601
See application file for complete search history.

(56) References Cited

U.S. PATENT DOCUMENTS 826,963 A * 7/1906 Pochyla ..... F04D 25/088 416/79
1,380,121 A * 5/1921 Stitzer ..... F21V 21/26 248/278.1
5,033,711 A * 7/1991 Gregorich ..... F16M 13/02 248/278.1
5,246,194 A * 9/1993 Garcia ..... G09F 7/18 52/764
5,490,655 A * 2/1996 Bates ..... H04N 5/64 248/329
6,729,592 B1 * 5/2004 Kurtts ..... F16M 13/022 248/278.1

(Continued)

FOREIGN PATENT DOCUMENTS

CN 107228079 A * 10/2017
CN 110219815 A * 9/2019

(Continued)

*Primary Examiner* — Taylor Morris
(74) *Attorney, Agent, or Firm* — Rosenberg, Klein & Lee

(57) ABSTRACT

A suspension assembly of industrial fans is provided. The suspension assembly of industrial fans includes a suspending main rod and a sub rod. A first adapter is pivotally disposed on a bottom end of the suspension main rod and provided with a plurality of first assembly holes. One end of the sub rod corresponding to the first adapter is pivotally connected with a second adapter which includes second assembly holes corresponding to the first assembly holes. A fan body is installed at the other end of the sub rod. According to environmental requirements and wind field coverage, directions and angles of air flows from the fan body can be changed by adjustment of relative positions of the second assembly holes of the second adapter to the first adapter. Therefore, good air circulation and ventilation in the environment is provided.

7 Claims, 10 Drawing Sheets

(56) References Cited

U.S. PATENT DOCUMENTS

| | | | | |
|---|---|---|---|---|
| 7,625,186 | B1 * | 12/2009 | Lueddecke | F04D 29/646 416/243 |
| 7,771,131 | B2 * | 8/2010 | Scott | G03B 17/00 396/428 |
| 8,020,823 | B2 * | 9/2011 | Wang | F16M 13/02 248/278.1 |
| 8,152,453 | B2 * | 4/2012 | Oleson | F04D 25/088 416/246 |
| 8,196,883 | B2 * | 6/2012 | Hirschhorn | F16M 11/2092 248/282.1 |
| 9,103,486 | B2 * | 8/2015 | Crowley | F24F 13/32 |
| 10,415,199 | B2 * | 9/2019 | Smothers | F04D 29/605 |
| 10,501,991 | B2 * | 12/2019 | Umlor | E06C 7/48 |
| 11,578,782 | B1 * | 2/2023 | Borgel | F04D 25/088 |
| 2007/0166179 | A1 * | 7/2007 | Pace | F04D 29/601 417/423.15 |
| 2009/0166444 | A1 * | 7/2009 | Peterson | F04D 29/601 416/247 R |
| 2009/0212184 | A1 * | 8/2009 | Bourgeois | F16M 11/2064 248/295.11 |
| 2009/0266958 | A1 * | 10/2009 | Meersman | F16B 2/065 248/231.51 |
| 2016/0018119 | A1 * | 1/2016 | Desmet | F24F 11/30 236/1 C |
| 2017/0167509 | A1 * | 6/2017 | Selig | F04D 29/384 |
| 2020/0170404 | A1 * | 6/2020 | Knapp | A47B 21/04 |
| 2023/0337792 | A1 * | 10/2023 | Dickerson | F04D 19/002 |
| 2024/0011503 | A1 * | 1/2024 | Tinapple | F04D 29/547 |

FOREIGN PATENT DOCUMENTS

| | | | | | |
|---|---|---|---|---|---|
| CN | 110285082 | A | * | 9/2019 | |
| CN | 110425166 | A | * | 11/2019 | |
| CN | 111997938 | A | * | 11/2020 | F04D 25/088 |
| CN | 112049807 | A | * | 12/2020 | |
| CN | 112628213 | A | * | 4/2021 | |
| CN | 112833053 | A | * | 5/2021 | F04D 29/002 |
| CN | 113153786 | A | * | 7/2021 | |
| JP | H05157092 | A | * | 6/1993 | F04D 25/088 |
| KR | 101006552 | B1 | * | 1/2011 | F04D 29/403 |
| KR | 101616730 | B1 | * | 4/2016 | F04D 25/06 |
| WO | WO-2017106316 | A1 | * | 6/2017 | F04D 25/06 |

* cited by examiner

SUSPENSION ASSEMBLY OF INDUSTRIAL FAN

BACKGROUND OF THE INVENTION

Field of the Invention

The present invention relates to a suspension assembly of industrial fans, especially to a suspension assembly of industrial fans which allows directions and angles of air flows from fans to be changed by adjustment of relative positions of two rods.

Description of Related Art

In a farm where poultry and livestock are raised, exhaust fans or large-scale electric fans are installed for air ventilation and removals of hot and moisture of indoor air. When the weather is hot or ventilation is poor, the fans work to lower temperature and improve ventilation for providing an ideal growing environment to domestic animals.

Most of large-scale electric fans used in a large environment or space such as a stock farm or hypermarket are suspended. The suspended fan is mounted to a suspending rod set on a roof (or ceiling) beam. One end of the suspending rod is fixed on the beam while the other end thereof is provided with a pivot base connected with a fan motor mount. An angle of the fan can be adjusted by the pivot base and rotated 180 degrees around the pivoted area. The fan can be adjusted to be arranged vertically or horizontally with limited angles to improve air flow and circulation in the large space such as the stock farm or hypermarket. However, the environment is three-dimensional and wind directions change with seasons. The fans which rotate axially within limited range such as 180 degrees can't meet the environmental requirements and thus the air flow in the space is unable to be adjusted properly.

SUMMARY OF THE INVENTION

Therefore, it is a primary object of the present invention to provide a suspension assembly of industrial fans which allows directions and angles of air flows from fans to be changed by adjustment of relative positions of two rods.

In order to achieve the above object, a suspension assembly of industrial fans according to the present invention mainly includes a suspending main rod and a sub rod. A first adapter is pivotally arranged at a bottom end of the suspension main rod and provided with a plurality of first assembly holes. One end of the sub rod corresponding to the first adapter is pivotally connected with a second adapter which includes second assembly holes corresponding to the first assembly holes while the other end of the sub rod is provided with a fan body. According to environmental requirements and wind field coverage, directions and angles of air flows from the fan body can be changed effectively by adjustment of relative positions of the second assembly holes of the second adapter to the first adapter. Therefore, good air circulation and ventilation in the environment is achieved.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
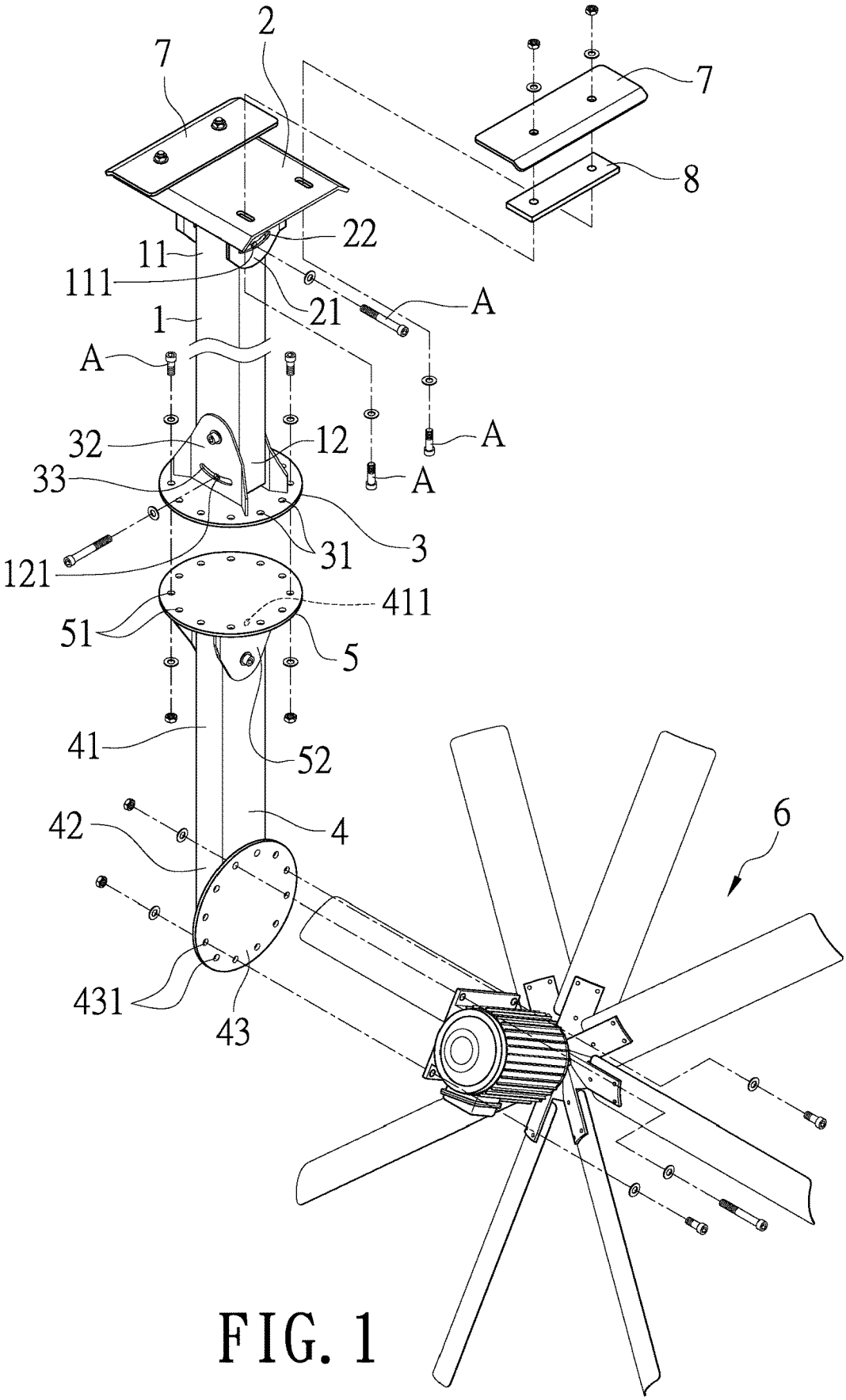
FIG. 1 is an exploded view of an embodiment according to the present invention.
Figure 2:
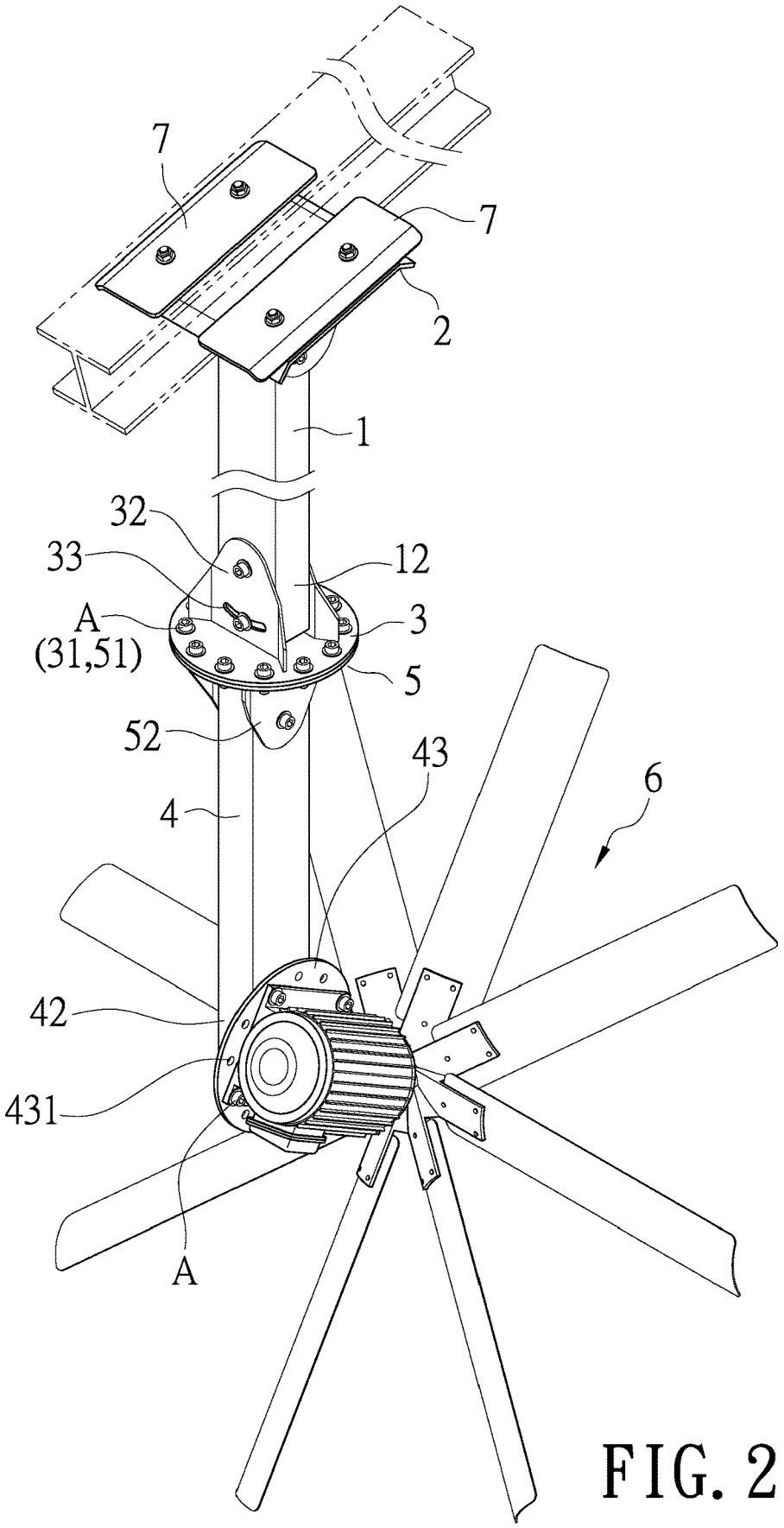
FIG. 2 is a schematic drawing showing an embodiment being assembled with a room beam according to the present invention.

Refer to FIG. 1 and FIG. 2, a suspension assembly of industrial fans according to the present invention includes a suspending main rod 1, a fixing base 2, a first adapter 3, a sub rod 4, and a second adapter 5.

The suspending main rod 1 includes a first end 11 and a second end 12 respectively pivotally connected with the fixing base 2 and the first adapter 3. The fixing base 2 is arranged at a place users intend to mount the suspension assembly of industrial fans while a plurality of first assembly holes 31 is disposed around a periphery of the first adapter 3.

The sub rod 4 consists of a first sub end 41 and a second sub end 42. The first sub end 41 is aligned with the suspending main rod 1 and pivotally connected with the second adapter 5. A plurality of second assembly holes 51 is arranged around a periphery of the second adapter 5 at positions corresponding to the first assembly holes 31 so that the second assembly holes 51 can be selectively connected and locked with the first assembly holes 31 correspondingly. A fan body 6 is installed at the second sub end 42.

As shown in FIG. 1 and FIG. 2, while being installed, the suspension assembly of industrial fans can be mounted in a large environment or space such as a stock farm, a hypermarket, a greenhouse, etc. First the fixing base 2 is mounted to a certain position of roof beams where users intend to arrange a suspending fan. Generally, steel I-beams are used in the stock farm and no assembly hole is found on the steel I-beam when users intend to assembly the fixing base 2 with the steel I-beam. Thus two positioning plates 7 are provided, aligned with the fixing base 2, and clamped on two sides of the steel I-beam correspondingly. A lining 8 providing assistance to clamping and fixing is disposed between the positioning plate 7 and the fixing base 2, and arranged adjacent to each of the two sides of the steel I-beam. Thereby the fixing base 2 are clamped and locked on the steel I-beam by a plurality of threaded fasteners A inserted through the positioning plates 7, the linings 8, and the fixing base 2 correspondingly.

Figure 3:
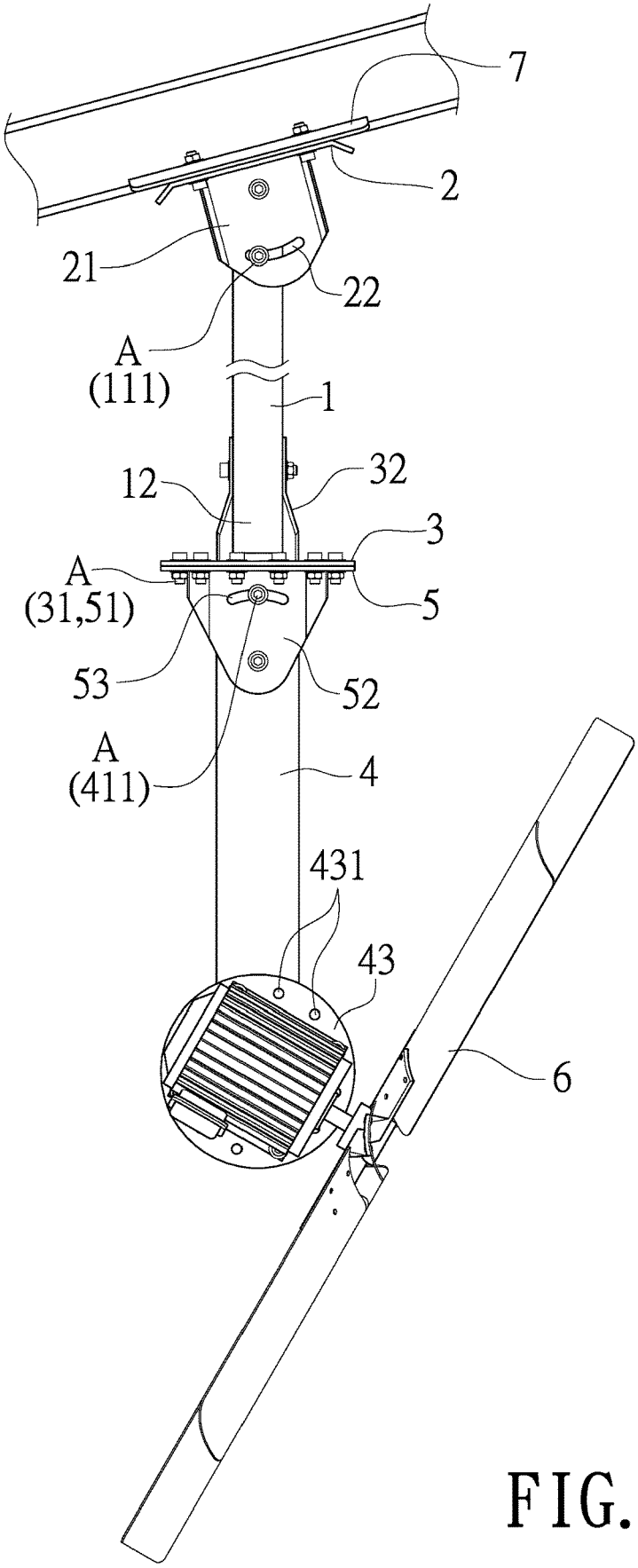
FIG. 3 is a side view showing an embodiment being assembled with a room beam according to the present invention.

Refer to FIG. 1 and FIG. 3, next the first end 11 of the suspending main rod 1 is pivotally disposed on the fixing base 2. Most of the roof beams are inclined. In order to keep the suspending main rod 1 pointing downwards vertically due to gravity, the fixing base 2 is provided with at least one pivot portion 21 and a curved slot 22 arranged at the pivot portion 21. A first fastening hole 111 is disposed on the first end 11 of the suspending main rod 1 at a position corresponding to the curved slot 22. Thereby an assembly angle of the suspending main rod 1 can be adjusted by the curved slot 22. For example, the angle is adjusted for allowing the suspending main rod 1 pointing downwards (as shown in FIG. 3) or in order to meet user's requirements. Then the suspending main rod 1 is locked and positioned by one threaded fastener A inserted through the curved slot 22 and the first fastening hole 111. Next the first adapter 3 is pivotally disposed on the second end 12 of the suspending main rod 1 to complete the assembly of the suspending main rod 1.

Figure 4:
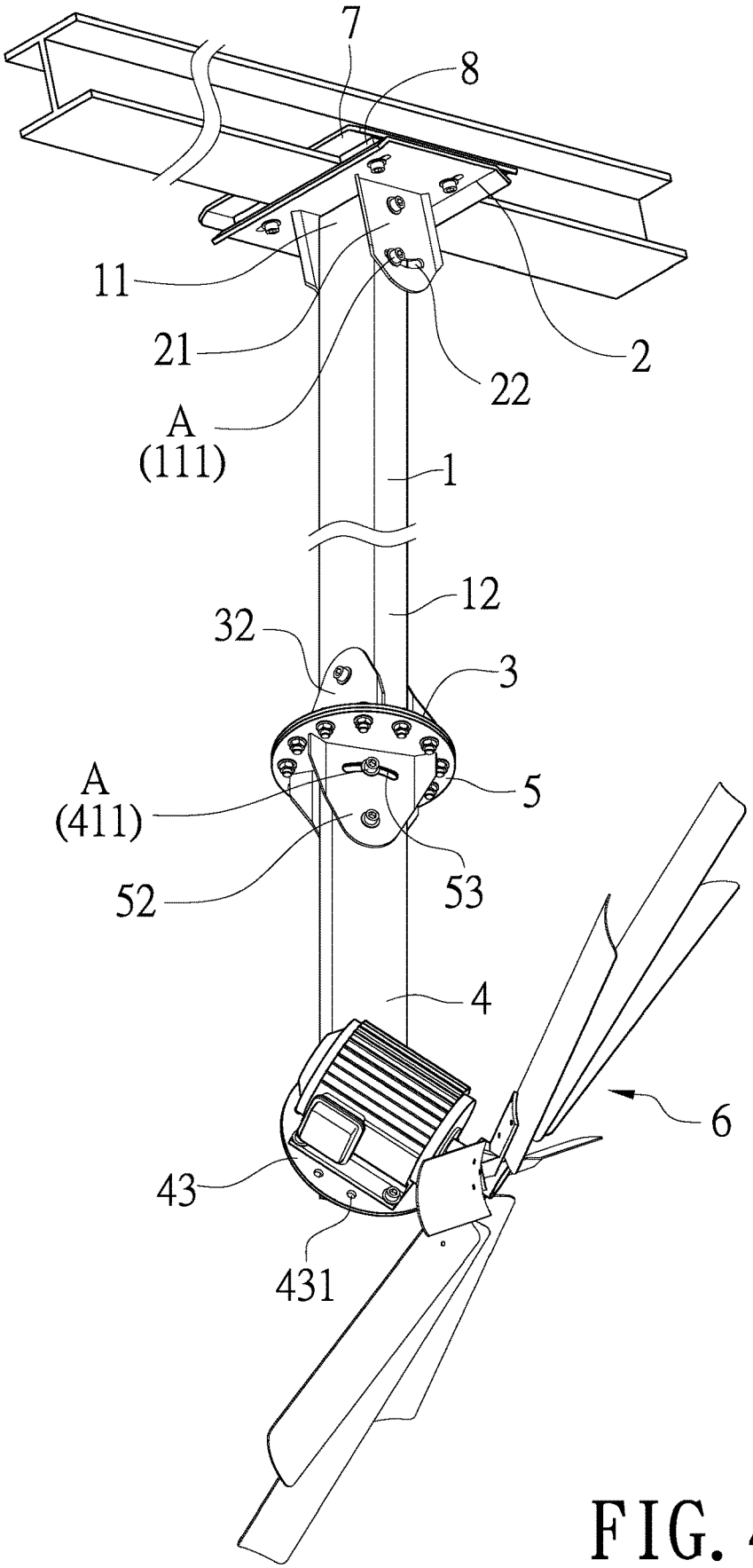
FIG. 4 is a schematic drawing showing a sub rod rotated 30 degrees with respect to a suspending main rod and then connected with the suspending main rod of an embodiment according to the present invention.
Figure 5:
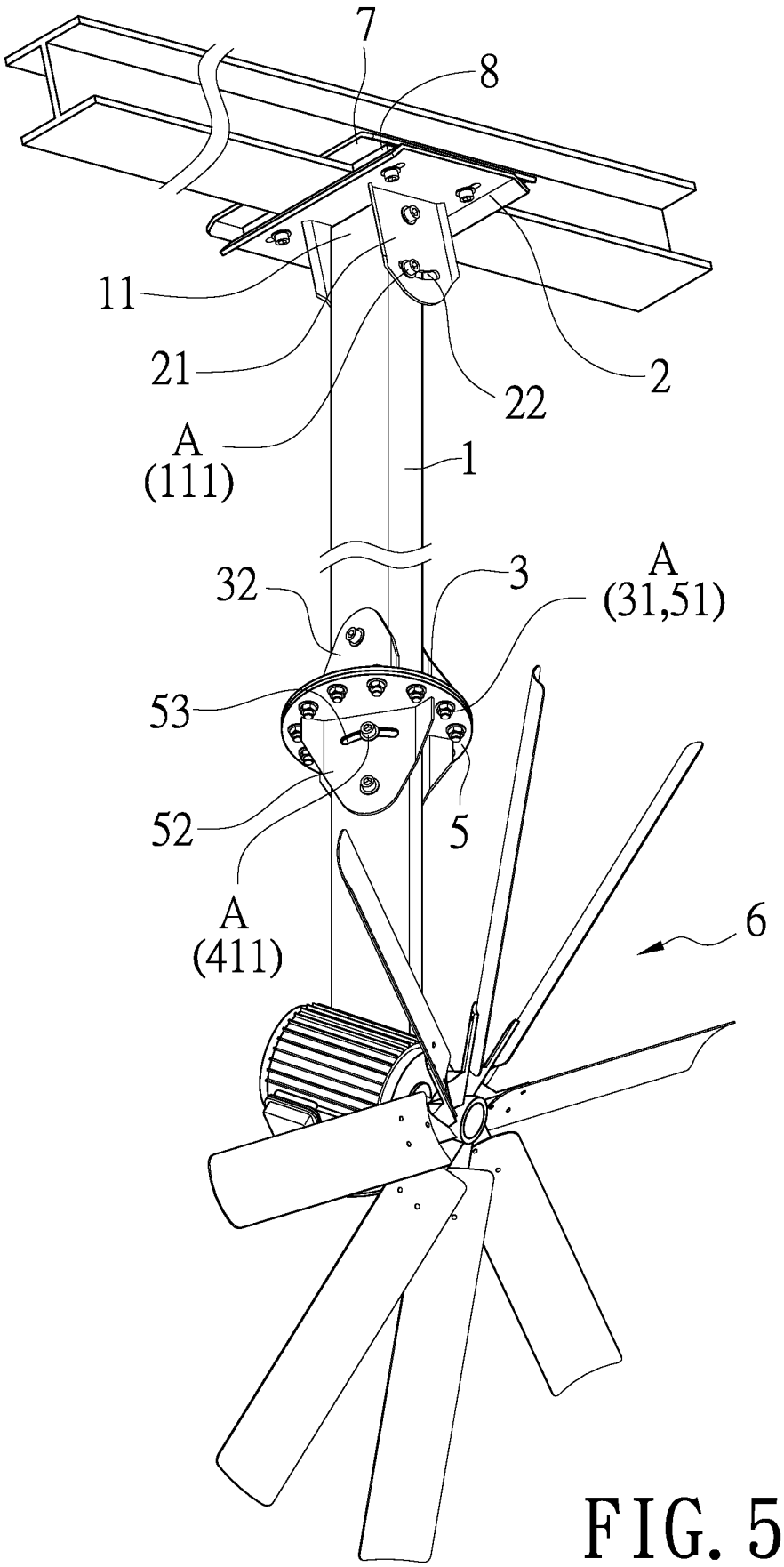
FIG. 5 is a schematic drawing showing a sub rod rotated 60 degrees with respect to a suspending main rod and then connected with the suspending main rod of an embodiment according to the present invention.
Figure 6:
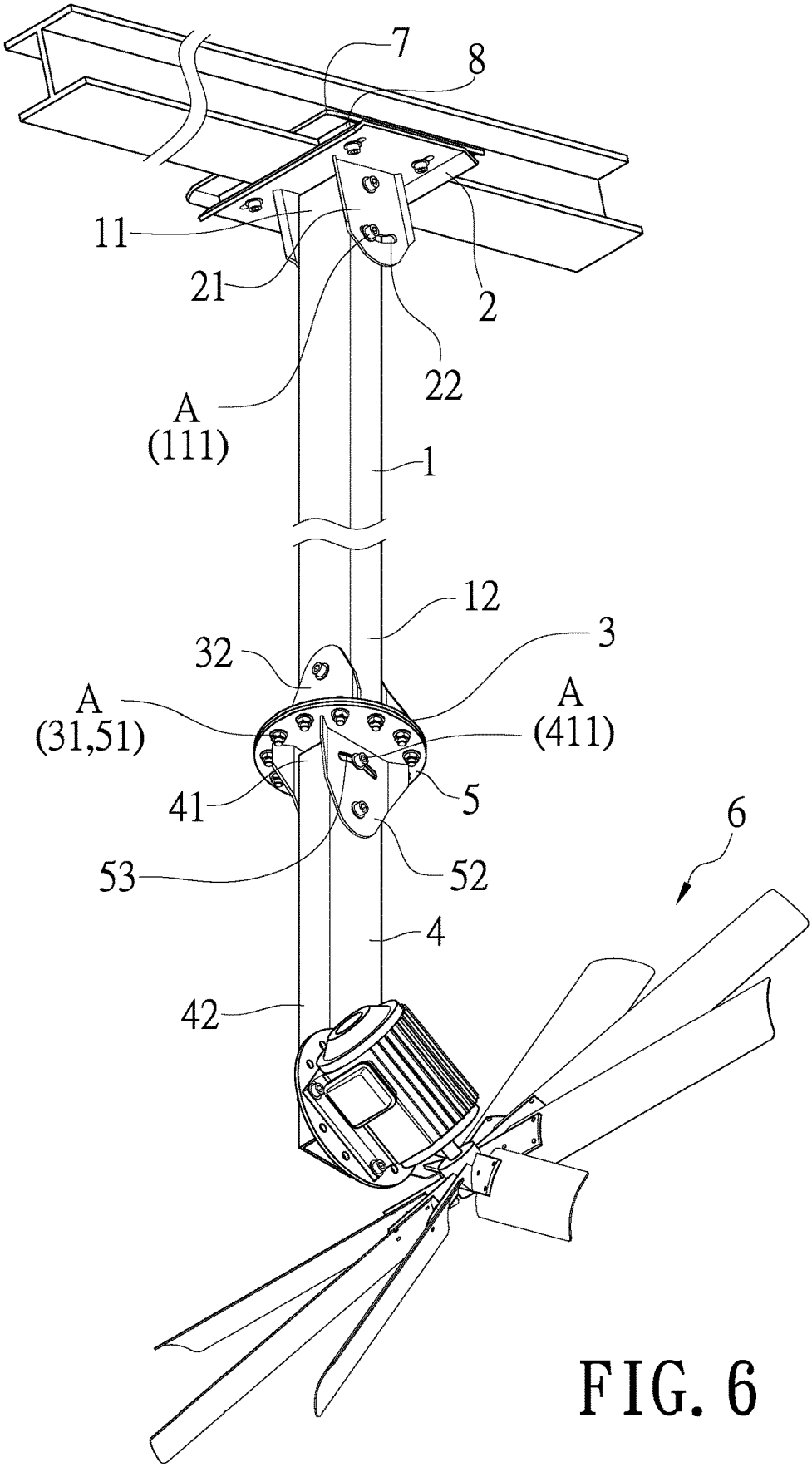
FIG. 6 is a schematic drawing showing a sub rod rotated 90 degrees with respect to a suspending main rod and then connected with the suspending main rod of an embodiment according to the present invention.

Refer to FIG. 4, FIG. 5, and FIG. 6, the sub rod 4 is installed after the assembly of the suspending main rod 1. The first sub end 41 of the rub rod 4 is pivotally connected with the second adapter 5 and then the second adapter 5 is aligned with the first adapter 3 of the suspending main rod 1. The sub rod 4 is connected with the suspending main rod 1 according to the angle required. For example, the second adapter 5 is rotated 30°, 60°, or 90° with respect to the first adapter 3 and then connected with each other. After the angle being determined, the second assembly holes 51 and the first assembly holes 31 are aligned and then inserted through by a plurality of threaded fasteners A for locking. Thereby the fan body 6 mounted to the second sub end 42 of the sub rod 4 makes an air flow (wind) in different directions and angles.

Figure 7:
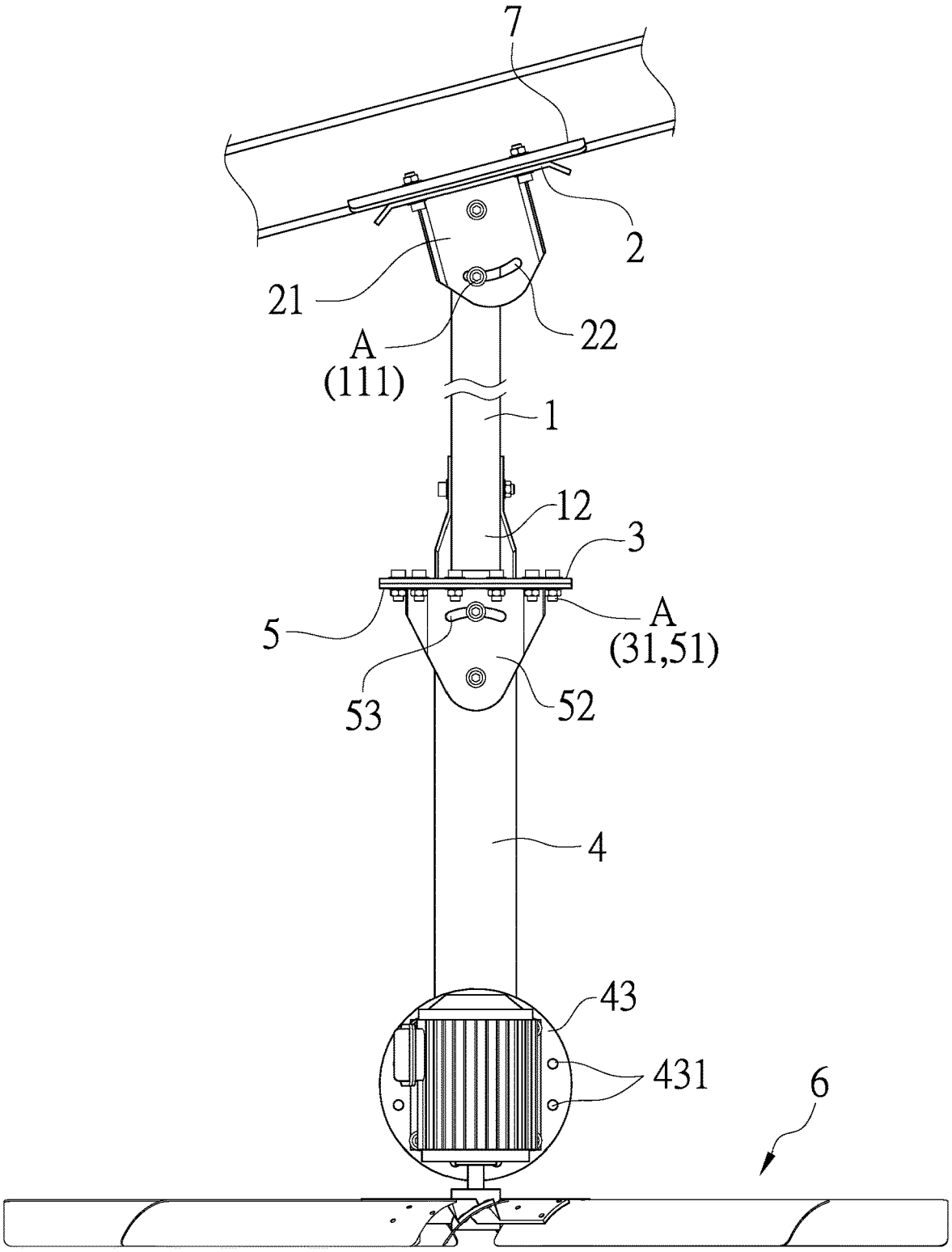
FIG. 7 is a schematic drawing showing a fan body facing downward of an embodiment after being assembled according to the present invention.
Figure 9:
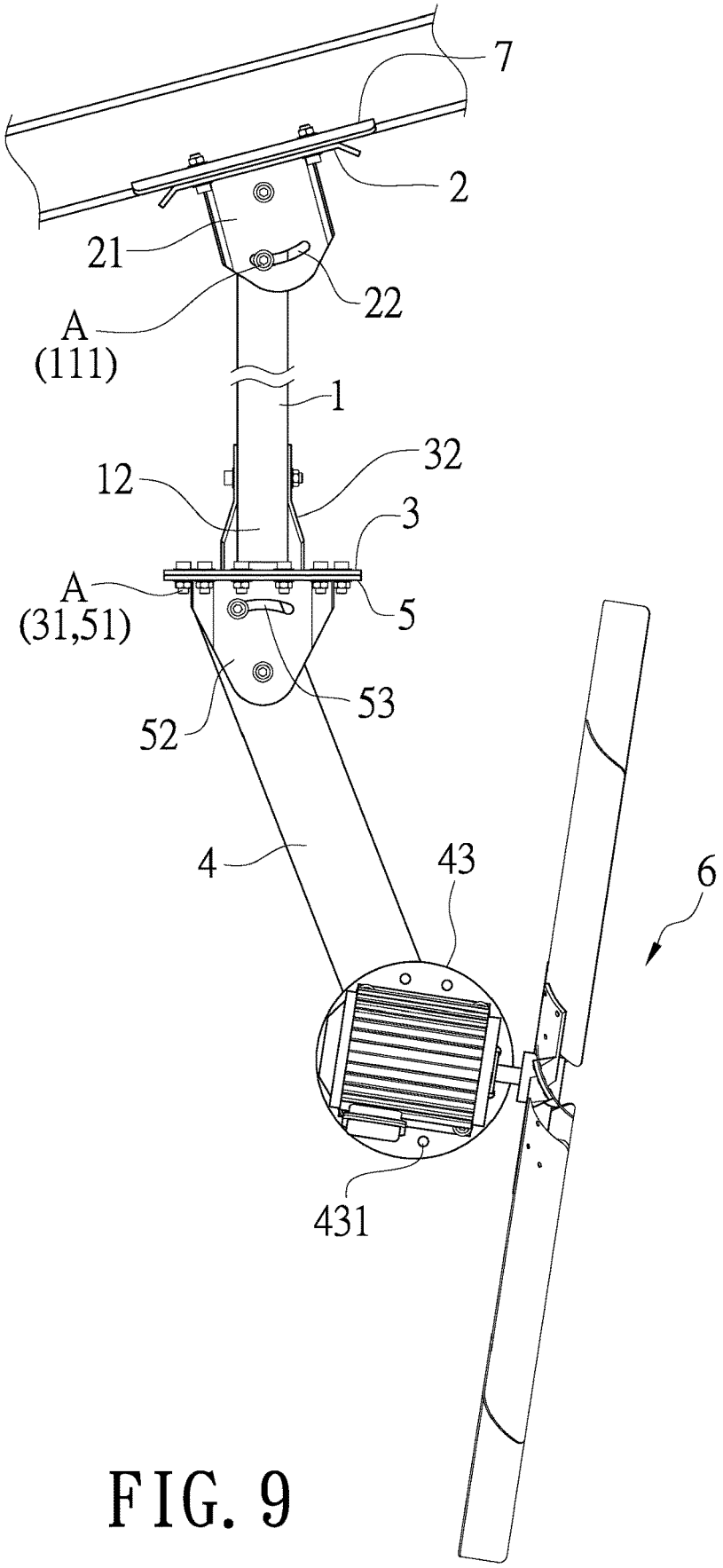
FIG. 9 is a schematic drawing showing angle adjustment of a second adapter relative to a sub rod of an embodiment according to the present invention.

Moreover, as shown in FIG. 7, a base 43 is arranged at the second sub end 42 of the sub rod 4 and provided with a plurality of third assembly holes 431 therearound for assembly with a support base of the fan body 6. A mounting direction of the fan body 6 relative to the base 43 can be changed according to the directions and angles of air flows required. For example, the angle of the fan body 6 is inclined about 45 degrees in FIG. 6, the fan body 6 is arranged horizontally to blow the air flow vertically downward in FIG. 7, or the fan body 6 is disposed at an angle of 90 degrees with respect to the base 43 as shown in FIG. 9. The fan body 6 is locked by a plurality of threaded fasteners A inserted through the third assembly holes 431.

Figure 8:
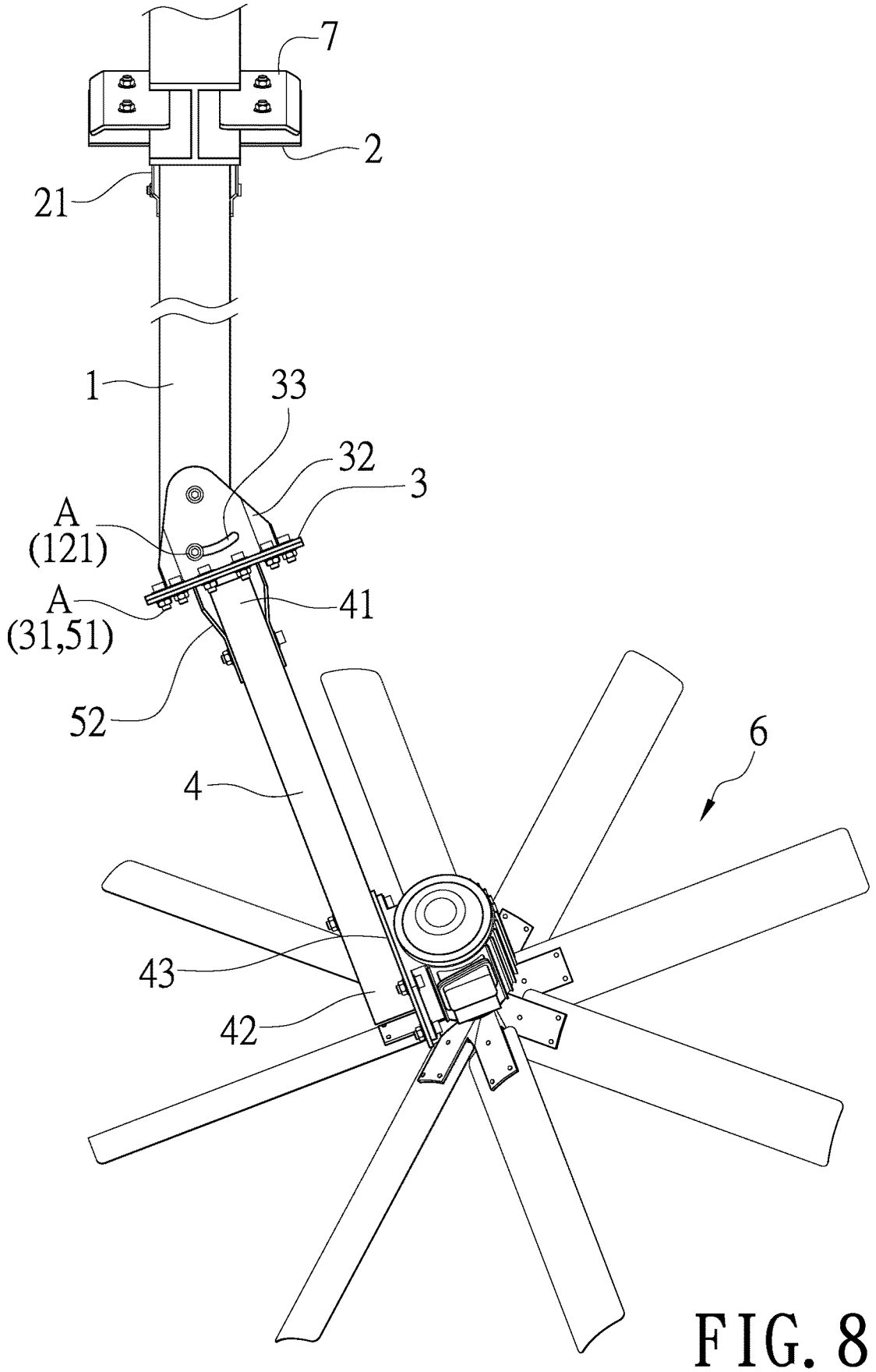
FIG. 8 is a schematic drawing showing angle adjustment of a first adapter relative to a suspending main rod of an embodiment according to the present invention.

Besides the above way for adjustment of the directions and angles of the air flows from the fan body 6, another angle adjustment design between the suspending main rod 1 and the first adapter 3 is also provided. As shown in FIG. 8, the first adapter 3 further includes a first pivot portion 32 and a first curved slot 33 arranged at the first pivot portion 32. A second fastening hole 121 is mounted on the second end 12 of the suspending main rod 1 and corresponding to the first curved slot 33. Thereby an assembly angle of the first adapter 3 relative to the suspending main rod 1 is adjusted using the first curved slot 33. The first adapter 3 is further locked and positioned by one threaded fastener A inserted through the first curved slot 33 and the second fastening hole 121.

Refer to FIG. 1 and FIG. 9, an angle between the sub rod 4 and the second adapter 5 can also be adjusted. The second adapter 5 further includes a second pivot portion 52 and a second curved slot 53 arranged at the second pivot portion 52. A third fastening hole 411 is mounted on the first sub end 41 of the sub rod 4 and corresponding to the second curved slot 53. Thereby an assembly angle of sub rod 4 relative to the second adapter 5 is adjusted using the second curved slot 53. The second adapter 5 is further locked and positioned on the sub rod 4 by one threaded fastener A inserted through the second curved slot 53 and the third fastening hole 411.

Figure 10:
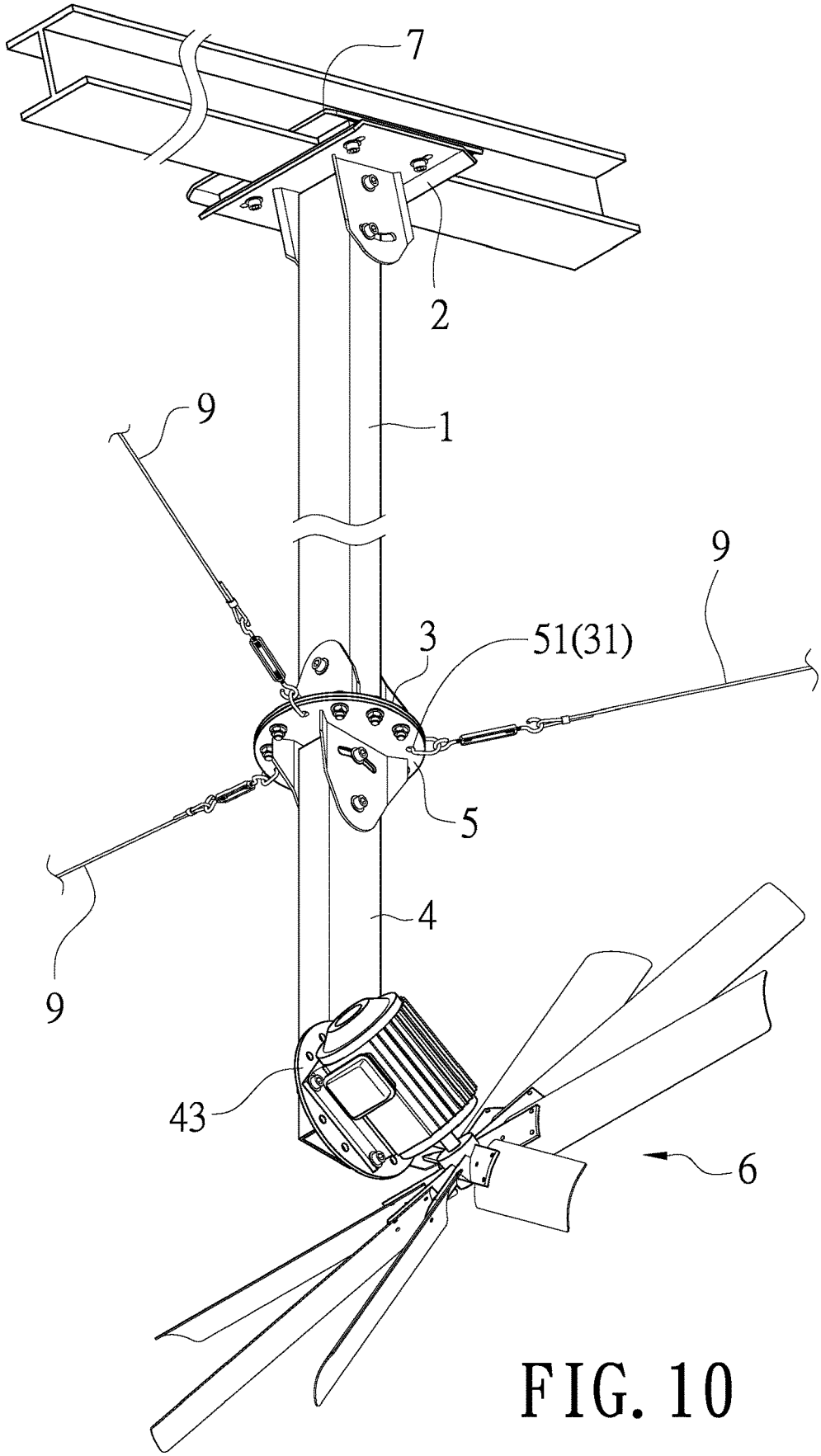
FIG. 10 is a schematic drawing showing an embodiment positioned by wires according to the present invention.

Furthermore, in order to increase stability and safety of the fan body 6 after being assembled, a plurality of wires 9 is inserted through the first assembly holes 31 of the first adapter 3 and the second assembly holes 51 of the second adapter 5 aligned with each other and then is fixed on the roof beam, as shown in FIG. 10. Thus the fan body 6 is secured after completing the assembly.

In summary, the present invention has the following advantages:

1. An angle of the sub rod relative to the suspending main rod can be adjusted 30 degrees or 60 degrees leftward or rightward. The directions and angles of the fans are adjusted according to owner's requirements so that the air flows can reach at least two areas. Thus there is no need to mount one fan at each area because each fan can cover larger area. Therefore, not only good heat dissipation and air ventilation are achieved, the cost is also saved.
2. The air flows from the fan can reach specific area the user intended to blow by changing relative assembly angles of the two adapters of the suspending main and the sub rods. The directions of the air flows can be changed according to environmental requirements and wind field coverage. Thereby good air circulation and ventilation in the environment can be achieved.
3. By the design of the adjustable angles of the suspending main rod relative to the fixing base and the first adapter, the sub rod relative to the second adapter, and the fan body relative to the base, installers can mount the fans at multiple places and adjust the angles of the fans within a wider range to meet the environmental requirements easier.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A suspension assembly of industrial fans comprising:

a suspending main rod having a first end and a second end respectively pivotally connected with a fixing base arranged at a mounting location and a first adapter provided with a plurality of first assembly holes around a periphery of the first adapter;

a sub rod which includes a first sub end corresponding to the suspending main rod and pivotally connected with a second adapter which is provided with a plurality of second assembly holes around a periphery of the second adapter and corresponding to the first assembly holes, and a second sub end provided with a base having a plurality of third assembly holes around a periphery of the base for assembly of a fan body at an angle correspondingly; the second assembly holes are able to be selectively connected and locked with the first assembly holes correspondingly, the first adapter further includes a first pivot portion and a first curved slot arranged at the first pivot portion; a second fastening hole is mounted on the second end of the suspending main rod and corresponding to the first curved slot; a threaded fastener is inserted through the first curved slot and the second fastening hole; the first curved slot is used for allowing the threaded fastener to move therewithin and adjustment of an assembly angle of the first adapter.

2. The suspension assembly of industrial fans as claimed in claim 1, wherein the fixing base is provided with at least one pivot portion and a curved slot disposed on the pivot portion; the first end of the suspending main rod is provided with a first fastening hole corresponding to the curved slot; the suspending main rod is locked and positioned by a threaded fastener inserted through the curved slot and the first fastening hole.

3. The suspension assembly of industrial fans as claimed in claim 1, wherein the second adapter further includes a second pivot portion and a second curved slot arranged at the second pivot portion; a third fastening hole is mounted on the first end of the sub rod and corresponding to the second curved slot; a threaded fastener is inserted through the second curved slot and the third fastening hole; the second curved slot is used for allowing the threaded fastener to move therewithin and adjustment of an assembly angle of the sub rod.

4. The suspension assembly of industrial fans as claimed in claim 1, wherein two positioning plates are arranged at two sides of the fixing base corresponding to said mounting location, aligned with the fixing base, and clamped at said mounting location; a lining providing assistance to clamping and fixing is disposed between the positioning plate and the fixing base; a threaded fastener is inserted through the positioning plate, the lining, and the fixing base for fixing.

5. The suspension assembly of industrial fans as claimed in claim 3, wherein two positioning plates are arranged at two sides of the fixing base corresponding said mounting location and aligned with the fixing base, and clamped on said mounting location; a lining providing assistance to clamping and fixing is disposed between the positioning plate and the fixing base; a threaded fastener is inserted through the positioning plate, the lining, and the fixing base for fixing.

6. The suspension assembly of industrial fans as claimed in claim 3, wherein a wire for positioning is inserted through the first assembly hole of the first adapter and the second assembly hole of the second adapter which are aligned with each other.

7. A suspension assembly of industrial fans comprising:

a suspending main rod having a first end and a second end respectively pivotally connected with a fixing base arranged at a mounting location and a first adapter provided with a plurality of first assembly holes around a periphery of the first adapter;

a sub rod which includes a first sub end corresponding to the suspending main rod and pivotally connected with a second adapter which is provided with a plurality of second assembly holes around a periphery of the second adapter and corresponding to the first assembly holes, and a second sub end provided with a base having a plurality of third assembly holes around a periphery of the base for assembly of a f an body at an angle correspondingly;

the second assembly holes are able to be selectively connected and locked with the first assembly holes correspondingly;

wherein a wire for positioning is inserted through the first assembly hole of the first adapter and the second assembly hole of the second adapter which are aligned with each other.

* * * * *